US006227802B1

(12) United States Patent
Torgerson et al.

(10) Patent No.: US 6,227,802 B1
(45) Date of Patent: May 8, 2001

(54) MULTISTAGE CENTRIFUGAL PUMP

(75) Inventors: Mathew John Torgerson, St. Paul; Wilbert Essig, Jr., Young America; Brent James Weyer, Crystal, all of MN (US)

(73) Assignee: Osmonics, Inc., Minnetonka, MN (US)

( * ) Notice: Subject to any disclaimer, the term of this patent is extended or adjusted under 35 U.S.C. 154(b) by 0 days.

(21) Appl. No.: 09/459,204

(22) Filed: Dec. 10, 1999

(51) Int. Cl.[7] ..... F03B 1/00

(52) U.S. Cl. ..... 415/199.2; 415/170.1; 417/423.14

(58) Field of Search ..... 415/199.1, 199.2, 415/199.3, 200, 170.1, 196, 197, 214.1, 182.1; 417/423.14, 423.1, 423.5

(56) References Cited

U.S. PATENT DOCUMENTS 4,293,288 * 10/1981 Weber ..... 415/199.3
4,669,956 6/1987 Brunel et al. ..... 415/201
4,708,589 11/1987 Nielsen et al. ..... 415/199.2
4,923,367 5/1990 Zimmer ..... 415/199.1
5,407,323 4/1995 Gay et al. ..... 415/200
5,700,138 * 12/1997 Bevington ..... 417/423.14
5,994,808 * 11/1999 Gross et al. ..... 417/423.1

* cited by examiner

*Primary Examiner*—Edward K. Look
*Assistant Examiner*—James M McAleenan
(74) *Attorney, Agent, or Firm*—Kinney & Lange, P.A.

(57) ABSTRACT

The invention concerns a fluid pumping apparatus including a pump unit having an inlet housing, a plurality of pumping stages, and a discharge housing, surrounded by a continuous layer of waterproof material. The waterproof layer is further surrounded by a structural shell. Moreover, the pump unit is threadably engaged to a motor adapter, and no tools are required for the attachment of the pump unit to, or removal of the pump unit from, the motor adapter. The motor adapter is designed so that the mechanical seal is easily accessible.

18 Claims, 5 Drawing Sheets

MULTISTAGE CENTRIFUGAL PUMP

CROSS-REFERENCE TO RELATED APPLICATION(S)

None.

BACKGROUND OF THE INVENTION

This invention relates to fluid pump construction and, in particular, to a multi-stage centrifugal pump.

Multi-stage fluid pumps are widely known and utilized in both commercial and residential applications. Such pumps use multiple pumping stages mounted to a rotating shaft to pump a fluid from one end of the pump to the other and to increase the fluid pressure. The pumping requirements determine the number and size of stages in the pump.

Fluid pumps involve a wide variety of design types, e.g., positive displacement, venturi and the like. One design type, a cylindrically-shaped centrifugal pump, is widely used to provide a pressurized water supply. Examples of such fluid pumps are described in U.S. Pat. No. 4,708,589 (Nielsen et al.) and U.S. Pat. No. 4,923,367 (Zimmer).

These fluid pumps comprise an inlet housing, a cartridge of stacked pump stages, and a discharge housing remote from the inlet. Each "stage" of such a pump has an impeller which "flings" water radially outward by centrifugal force; each stage also includes a diffuser assembly which encloses the impeller. The diffuser assembly may consist of one or more components. Typically, a plurality of such stages are "stacked" so that the discharge portion of one stage feeds liquid into the inlet portion of the next stage. For applications where the pump is not submerged in water, a pump casing, or shell, surrounds the cartridge of stacked stages, the inlet housing, and the discharge housing. An impeller or drive shaft, coupled to a motor shaft, extends axially through the cartridge and is fixed to the impeller within each of the stages. Rotation of the drive shaft thus turns each impeller to force fluid radially outward toward an adjacent, stationary diffuser. In turn, the cooperating diffuser directs the fluid radially inwardly and toward the next pump stage. At the inlet end of the cartridge is a motor adapter for receiving and mounting an electric motor. At the discharge end of the cartridge is an outlet from which pumped water flows.

For leakage prevention and pump efficiency, it is desirable to retain the inlet housing, the pump stages, and the discharge housing snugly compressed against one another. In one type of prior art pump, as shown by Nielsen in U.S. Pat. No. 4,708,589, compression is accomplished by a hollow, cylindrical metal shell sleeved over the stacked stages. One way compression is maintained is by crimping the shell to a motor adapter on one end and an output flange on the other. Another way is by having formed screw threads on the shell which are engageable with complementary threads on the discharge housing and the inlet housing. During assembly, the stages are slipped into the casing and the inlet and discharge housings are then threaded into the casing until they engage respective ends of the stage cartridge. Rotation may be prevented by a set screw or other fastener. The diffusers of such pumps are thus held stationary by the axial force exerted on the cartridge by the inlet and discharge housings once the latter are tightened. In another type of pump, as shown by Zimmer in U.S. Pat. No. 4,923.367, the shell is embodied as a pair of plastic half-cylinders joined together by fasteners. Compression of the stages is provided by an adjustment cone rather than by the shell.

In such prior art pumps, the axial force of the housings against the cartridge is sometimes insufficient to preclude lateral movement of the diffusers along the drive shaft because the compressive force holding the stages against each other can decrease over time. As a result, the stages (or parts of stages) may separate slightly, allowing leaks to develop. Moreover, as the axial compressive forces diminish, they may not provide sufficient frictional forces to preclude rotation of the diffuser plates and/or the diffusers (which are subjected to torsional forces by the moving water in the pulp). Both leakage and unwanted rotation of pump parts result in a decrease in pump performance.

Another disadvantage arises merely from the fact that many known pump shells are made of metal, such as stainless steel. Such shells are relatively thin walled and may dent if dropped. In a severe case, a diffuser or diffuser plate within the shell may be fractured. Fabricating stainless steel components is also a relatively expensive process. If ordinary steel, a less expensive material, is selected for the shell or for other components, rust and corrosion are inevitable. Further, for a shell of given dimensions, metal shells weigh more than those made with alternative materials such as plastic. Fabricating plastic and composites is typically a less expensive process than using materials such as stainless steel.

While most shelled pumps use metal shells, some have used glass-filled thermoplastic shells. Gay et al. teach, in U.S. Pat. No. 5,407,323, the construction of a multistage centrifugal pump with a polymeric composite (wound fiberglass) shell. An essential element of the '323 invention is that the shell is bonded directly to the pump stage diffusers in an attempt to create a water tight seal. However, in practice, it has been found that fiberglass on its own is not waterproof; water may "weep" through the channels of the fibers, resulting in leakage through the shell.

BRIEF SUMMARY OF THE INVENTION

The present invention overcomes the disadvantages of the prior known pump constructions by providing a pump shell which eliminates fluid leakage and thus enhances pump performance while reducing manufacturing costs.

The present invention includes a stage containment system which encapsulates an inlet housing, one or more pump stages, and a discharge housing, resulting in a fully encapsulated disposable pump unit. Each pump stage consists of a diffuser plate and a diffuser which cooperate to house an impeller. Two or more pump stages are typically arranged to abut one another in "stacked" relationship to increase pump pressure output and form the cartridge of the pump. An impeller shaft is drivably connected to the motor, which is mounted by a motor adapter to the inlet end of the pump. The shaft extends axially through the pump to drive the individual impellers.

In one preferred embodiment, a shrink-wrap inner shell used with o-rings forms a leak-proof pump unit casing by providing compressive forces which hold the inlet housing, the discharge housing, and the pump stages in a fixed relationship to each other. Moreover, the compressive forces prevent rotation of the pump stages in response to torque forces. A composite outer shell lends structural integrity.

In another preferred embodiment, the inner shell is in the form of a waterproof coating. The coating layer provides a leak-proof casing, and also prevents diffuser rotation, by bonding with the inlet housing, the pump stages, and the discharge housing. Similarly, a composite outer shell provides structural strength.

In a preferred embodiment, the encapsulated pump unit is threadably engaged to the motor adapter. This "quick connect" feature allows the pump unit to be easily and quickly attached and removed from the motor without the use of tools. This modularity gives a user a convenient way to replace individual pump units as needed. Furthermore, the present invention provides for a motor adapter design that allows easy access to the mechanical seal.

DETAILED DESCRIPTION

Figure 1:
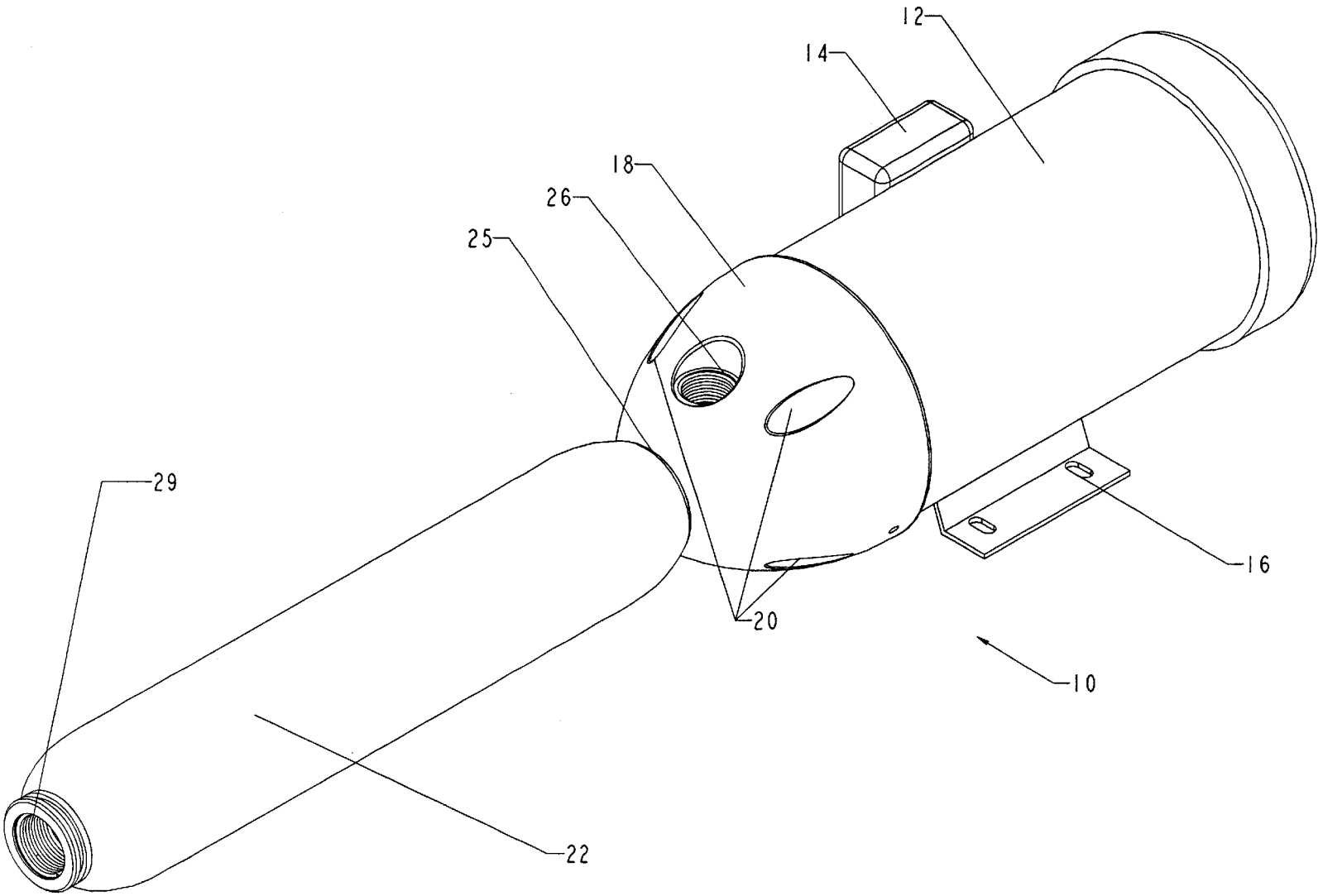
FIG. 1 is a perspective view of the exterior of a fluid pump unit and motor adapter embodying the present invention, attached to a motor.

FIG. 1 shows a multi-stage centrifugal pump assembly 10 embodying the present invention. Assembly 10 includes motor 12, motor adapter 18, and pump unit 22. Motor 12 includes electrical junction box 14 and mounting piece 16. Motor adapter 18 includes water inlet 26 and bolt openings 20. Pump unit 22 includes inlet port 25 and discharge port 29.

Motor 12 contains electrical junction box 14 and mounting piece 16 for the attachment of motor 12 to other equipment as necessary for a particular operation. Motor adapter 18 is bolted onto motor 12 by four screws inserted into openings 20. A shaft coupling connects the drive shaft of motor 12 to an impeller shaft which extends into pump unit 22. Pump unit 22 slides over the impeller shaft, and inlet housing 24 of pump unit 22 threads onto a threaded nipple (to be explained with reference to FIG. 4) of motor adapter 18. Motor adapter 18 contains water inlet 26, which initiates water flow through pump unit 22. The impeller shaft drives impellers within pump unit 22, thereby pumping water from water inlet 26, through inlet port 25, through pump unit 22, and out discharge housing 28 and discharge port 29. The details of operation will be explained with reference to FIG. 2.

Figure 2:
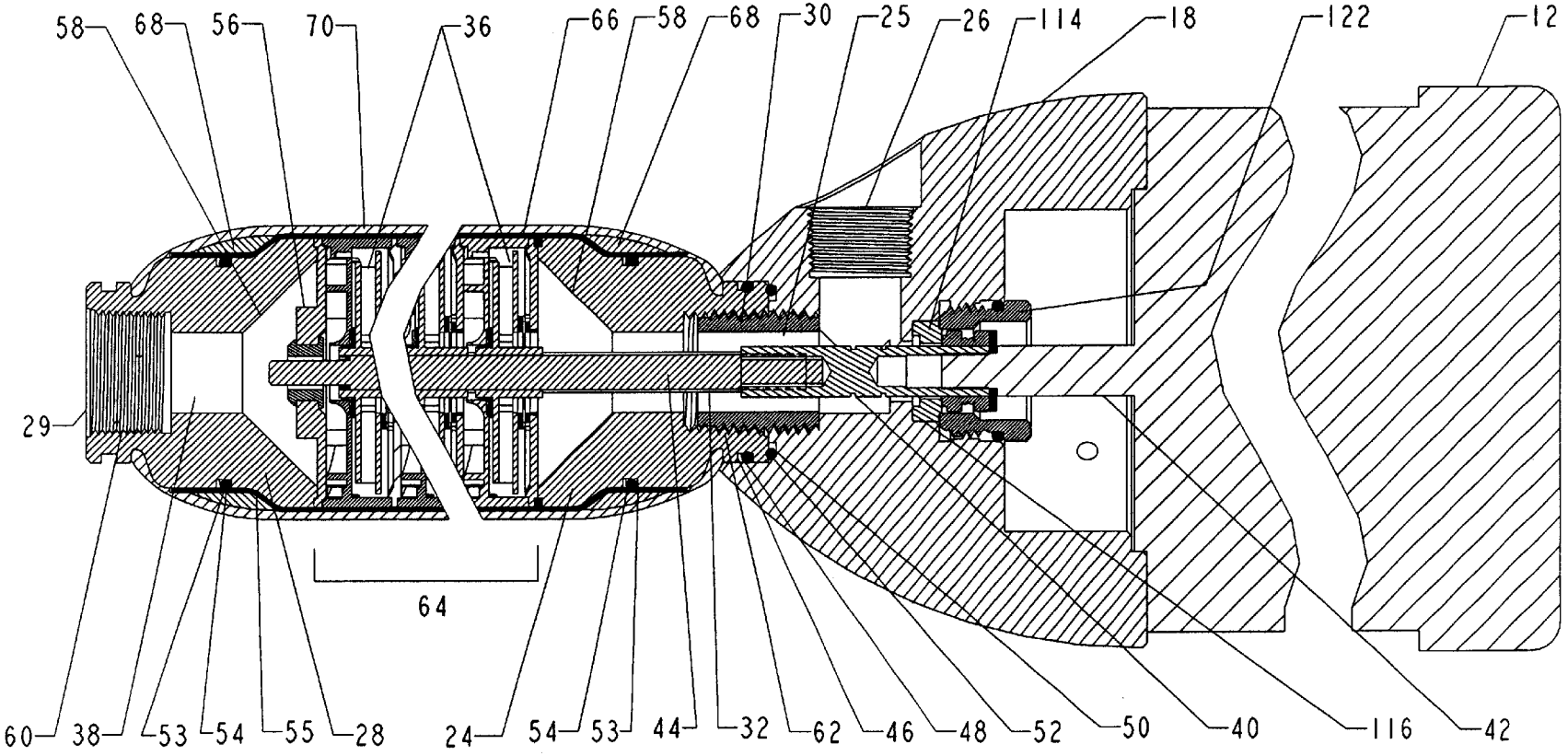
FIG. 2 is a cross sectional view of a pump unit, motor adapter, and motor assembly of a first preferred embodiment.

FIG. 2 shows multi-stage centrifugal pump assembly 10 in cross section, illustrating the connections between motor 12, motor adapter 18, and pump unit 22. Motor 12 includes motor shaft 42. Motor adapter 18 includes water inlet 26, o-ring groove 50, o-ring 52, mechanical seal stationary seat 114, bore 116, and seal holder 122. Pump unit 22 includes inlet housing 24, inlet port 25, discharge housing 28, discharge port 29, inlet housing bore 32, pump stages 36, discharge housing bore 38, o-ring groove 46, o-ring 48, o-ring grooves 53, o-rings 54, step 55, discharge bearing 56, bores 58, discharge threads 60, inlet threads 62, shrink-wrap lining 66, o-ring compression collars 68, and structural shell 70.

The water to be pumped flows from water inlet 26, through threaded nipple 30, through port 25 and bore 32 of inlet housing 24, through pump stages 36, and out bore 38 and port 29 of discharge housing 28. Shaft coupling 40 within motor adapter 18 joins motor shaft 42 of motor 12 to impeller shaft 44. The details of the connection between motor 12 and motor adapter 18 will be explained later in this description, with reference to FIG. 4. Impeller shaft 44 extends axially through pump unit 22 to drive stages 36.

Pump unit 22 slides over impeller shaft 44; inlet housing 24 of pump unit 22 threads onto threaded nipple 30 of motor adapter 18 and is tightened by hand. An improvement of the present invention over the prior art lies in its modularity and ease of assembly and disassembly. If pump unit 22 fails, the failed unit can be easily removed and replaced by a new encapsulated pump unit, quickly and without tools. This allows for a lower capital investment by a customer who desires to have backup pump units on hand. The customer can invest in extra pump units rather than complete assemblies of pump units, motor adapters, and motors. Inlet housing 24 has o-ring groove 46 to accommodate o-ring 48. Motor adapter 18 has o-ring groove 50 to accommodate o-ring 52. When pump unit 22 and motor adapter 18 are threaded together, o-rings 48 and 52 prevent leakage of water flowing through motor adapter 18 and inlet lousing 24. While prior art pumps can be separated into a pump unit, a motor adapter, and a motor, the pump unit and motor adapter generally require tools for assembly and disassembly.

Inlet housing 24 and discharge housing 28 are preferably molded from a plastic material in order to reduce manufacturing costs while also reducing the overall weight of pump unit 22. The inlet and discharge housings, 24 and 28 respectively, are preferably molded of the same materials using the same mold. O-ring groove 53 and step 55 are molded into the circumference of both inlet housing 24 and discharge housing 28. Inlet housing 24 and discharge housing 28 both have central cylindrical bores, inlet bore 32 and outlet bore 38, thorough which liquid passes. Referring to discharge housing 28, a portion of it may be machined away to provide space for discharge bearing 56. As contemplated, the primary difference between inlet housing 24 and discharge housing 28 is in the threads of each piece. For example, threads 60 on discharge housing 28 may be 1 inch standard pipe threads, and threads 62 on inlet housing 24 may be 1½ inch straight threads. Bore 58 and threads 60 and 62 may be either machined into pre-molded pieces or molded into the pieces initially. Each of inlet housing 24 and discharge housing 28 have grooves 53 to accommodate o-rings 54.

Between inlet housing 24 and outlet housing 28 lie a plurality of identical pump stages 36. Pump stages 36 are stacked in contiguous relation to each other concentric with impeller shaft 44. This stack of pump stages 36 may be referred to as cartridge 64. A detailed description of the internal mechanics of pump unit 22 will be recited later, with reference to FIG. 3.

Figure 3:
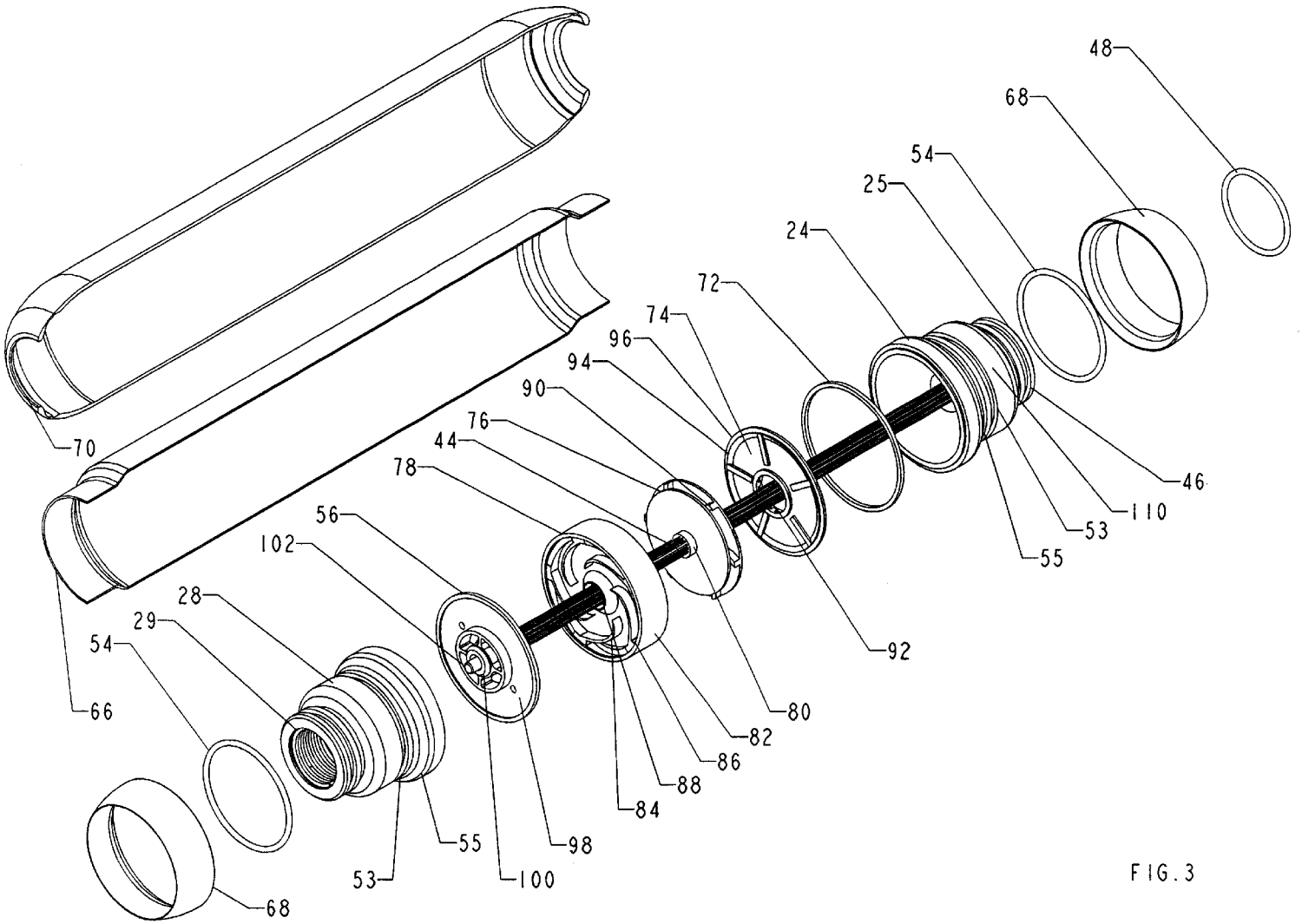
FIG. 3 is an exploded view of the pump unit.

In one preferred embodiment, O-rings 54 are placed in each of the o-ring grooves 53. Then, an external, temporary, axial compressive force is applied to align and compress together inlet housing 24, stages 36, and discharge housing 28. A one-piece resilient polymeric shrink-wrap sleeve 66, made of a material such as polyolefin, is slipped over cartridge 64, inlet housing 24, and discharge housing 28. The thickness of shrink-wrap sleeve 66 may vary greatly, but in this example, a thickness of about 40 thousandths of an inch to about 60 thousandths of an inch has been found to work well. The entire pump unit 22 is then heated to shrink sleeve 66 so that it conforms to the shape of inlet housing 24, cartridge 64. and discharge housing 28. O-ring compression collars 68 are placed over each o-ring 54, in the space provided by step 55, to provide even compression on o-rings 54. FIG. 2 shows shrink-wrap sleeve 66 after heating, in cross-section. Then, composite shell 70, preferably made of a material such as a long fiber composite (e.g., e-glass/epoxy fiberglass), is formed around the outside of shrink-wrap sleeve 66 and o-ring compression collars 68 to provide structural integrity. The thickness of composite shell 70 may vary greatly, but in this example, a thickness of about 40 thousandths of an inch has been found to work well. Preferably, composite shell 70 has circumferential as well as bias layers of fiberglass for strength. Once shell 70 is cured, the temporary external axial force is removed, and the result is a fully encapsulated disposable pump unit. FIG. 3 shows an exploded view of pump unit 22. Pump unit 22 includes structural shell 70, shrink-wrap lining 66, o-ring compression collars 68, o-rings 48 and 54, inlet housing 24, discharge housing 28, impeller shaft 44, discharge bearing 56, diffuser 78, impeller 76, diffuser plate 74, and diffuser plate adapter ring 72. Inlet housing 24 further includes inlet housing port 25, o-ring grooves 46 and 53, and step 54. Diffuser plate 74 further includes central opening 92, circular offset 94, and outer cylindrical edge 96. Impeller 76 further includes hub 80 and vanes 90. Diffuser 78 further includes cylindrical wall surface 82. vanes 84, openings 86, and central circular opening 88. Discharge bearing 56 further includes disk 98 and bearing 100. Discharge housing 28 further includes discharge housing port 29, o-ring groove 53, and step 54. Impeller shaft 44 includes ends 102 and 110.

Between inlet housing 24 and the first of the pump stages 36, a diffuser plate adapter ring 72 may be used to fill the "step" between diffuser plate 74 and inlet housin, 94. Adapter 72 may be necessary due to the geometry of inlet housing 24 and diffuser plate 74. Adjacent to diffuser plate adapter ring 74 lie one or more pump stages 36.

While FIG. 3 shows the components of only one stage 36 in detail, it is to be understood that a typical pump unit 22 uses a plurality of identical stages 36 stacked on impeller shaft 44. Fach pump stage 36 includes a centrifugal impeller 76, a diffuser plate 74, and a diffuser 78. Impeller 76 is confined within the diffuser plate and diffuser assembly. Impeller shaft 44 is inserted through keyhub 80 of each impeller 76 and thereby drives such impellers 76. Pump stages 36 are preferably formed of plastic materials in order to reduce the weight of pump unit 22 while ensuring smooth, efficient operation. Noryl, a thermoplastic manufactured by General Electric, is preferably used for pump stages 36, diffuser plate adapter ring 72, and discharge bearing 56. A filled variety of Noryl may also be used.

Diffuser 78 has a cylindrical wall surface 82 on its periphery and radial vanes 84 on one side. Radial vanes 84 define fluid passageways which terminate in a plurality of circumferentially spaced openings 86 at the perimeter of diffuser 78. A central circular opening 88 fitted with a metal bushing (not shown) is sized to provide a running fit with hub 80 of impeller 76.

Impeller 76 includes a plurality of vanes 90 for directing fluid flow centrifugally outwardly as impeller shaft 44 rotates impeller 76. Impeller 76 has an eye, or water inlet opening, on its opposite side (not shown) of larger diameter than, and coaxial with, hub 80.

Each of the stages 36 also includes a generally flat diffuser plate 74 having a central opening 92 for passage of fluid from the central areas of the preceding diffuser 78 toward the impeller eye of the next adjacent stage 36. The periphery of each of the diffuser plates 74 is provided with a circular offset 94 which complementally fits within the adjacent diffuser 78 to provide locating shoulders to properly position plate 74 in the stacked assembly. Diffuser plate 74 has a relatively narrow outer cylindrical edge 96 of a diameter that is substantially equivalent to a relatively wide, cylindrical wall surface 82 forming the periphery of diffuser 78.

Discharge bearing 56 is disposed between the last pump stage and discharge housing 28. Discharge bearing 56 typically includes a disk 98 and a cylindrical rubber bearing 100 inserted in the center of disk 98. The diameter of disk 98 is substantially equivalent to that of the diffuser plates 74 and diffusers 78. Discharge bearing 56 rides on the end 102 of impeller shaft 44 to support shaft 44, keeping it centered and straight within pump unit 22.

O-rings 54 are placed in o-ring grooves 53 of inlet housing 24 and discharge housing 28. Then sleeve 66 is slipped over inlet housing 24, pump stages 36, and discharge housing 28, and heated so that it shrinks to conform to the shape of inlet housing 24, pump stages 36, and discharge housing 28. o-ring compression collars 68 are placed over shrink-wrap sleeve 66 and positioned over each o-ring 54, in the space provided by step 55. Then, composite shell 70 is formed around the outside of shrink-wrap sleeve 66 and o-ring compression collars 68 to provide structural integrity. FIG. 3 shows one-half of shrink-wrap sleeve 66 and one-half of composite shell 70, in perspective. This view is for illustrative purposes only; in practice, sleeve 66 and composite shell 70 are each preferably composed of one continuous piece of material, not two halves joined together.

O-ring 48 is placed into o-ring groove 46 of inlet housing 24, and o-ring 52 is placed into o-ring groove 50 of motor adapter 18. When pump unit 22 is threaded onto threaded nipple 30, o-rings 48 and 52 help seal the juncture between pump unit 22 and motor adapter 18.

This pump stage containment system, consisting of o-rings 54, shrink-wrap sleeve 66, o-ring compression collars 68, and composite shell 70, uses mechanical forces, rather than chemical bonding, to accomplish a watertight seal and prevent diffuser rotation. It can be appreciated that the fluid forces of the swirling water stream created by operation of impellers 76 exert a substantial rotative force on vanes 84 of diffusers 78. However, it has been found that compression of the shrink-wrap casing 66 on the walls 82 of the diffusers 78 and the complete circumferential contact between casing 66 and diffusers 78 provide sufficient frictional forces for retaining diffusers 78 in a stationary position as impellers 76 are rotated. The fit of cartridge 64 within casing 66 enables the latter to exert a plurality of equal, radially inwardly directed forces toward cartridge 64 such that each of the diffusers 78 and diffuser plates 74 are retained in substantial alignment relative to each other.

Figure 4:
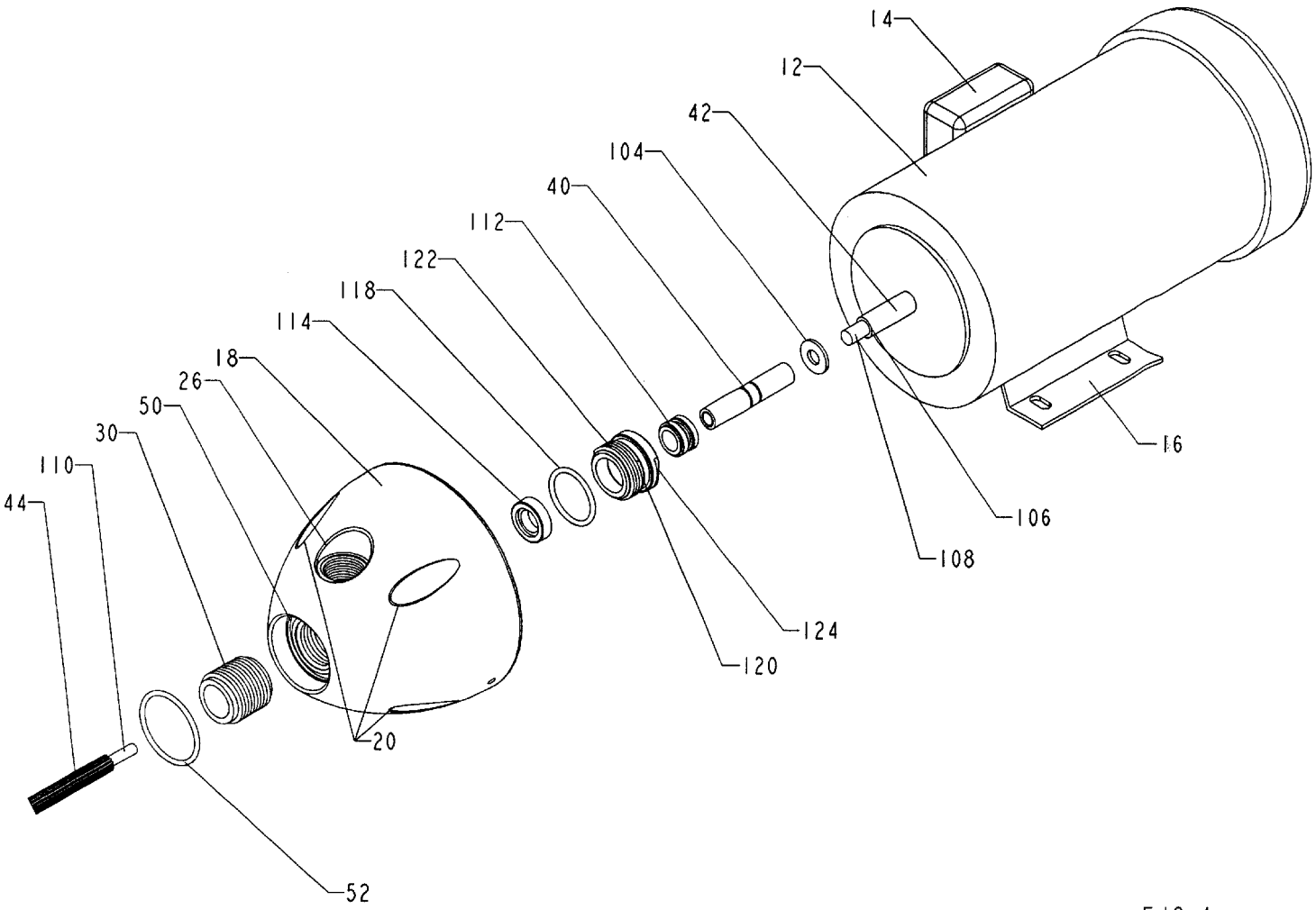
FIG. 4 is an exploded view of the motor adapter and motor assembly.

FIG. 4 illustrates the manner in which motor adapter 18 connects motor 12 and pump unit 22. FIG. 4 shows motor 12 with electrical junction box 14 and motor mounting piece 16; motor shaft 42 with shoulder 106 and end 108; washer 104; mechanical seal 112; shaft coupling 40; mechanical seal holder 122 with relief area 120 and flats 124; o-ring 118; mechanical seal stationary seat 114; motor adapter 18 with water inlet 26 and openings 20; threaded nipple 30; o-ring 52; o-ring groove 50; and impeller shaft 44 with end 110.

Washer 104 slides onto motor shaft 42 and abuts against shoulder 106 of motor shaft 42. Then, shaft coupling 40 is attached onto end 108 of motor shaft 42. End 110 of impeller shaft 44 is attached onto the other end of shaft coupling 40. Substantially cylindrical mechanical seal 112 slides onto coupling 40 and abuts washer 104. Mechanical seal stationary seat 114 presses into bore 116 (more easily seen in FIG. 2) of motor adapter 18. O-ring 118 is placed in relief area 120 of seal holder 122. Substantially cylindrical seal holder 122 is threaded onto motor adapter 18 to hold mechanical seal stationary seat 114 in place. Motor adapter 18 then slides over impeller shaft 44 and abuts motor 12. Motor adapter 18 is then attached onto motor 12 using four screws (as dictated by the type of motor) (not shown), through openings 20. When motor adapter 18 and motor 12 are connected, seal holder 122 concentrically surrounds mechanical seal 112 and imparts correct compression on the mechanical seal components. Mechanical seal 112 contains a spring which allows it to retain the correct amount of compression, even as the seal material wears down over time. This feature allows the seal to have a much longer useful life.

Another novel feature of the motor adapter of the present invention is the easy accessibility of mechanical seal 112 and mechanical seal stationary seat 114. Mechanical seal 112 and mechanical seal stationary seat 114 are designed to be easily serviceable by requiring only two disassembly steps that use common tools. Motor adapter 18 is removed from motor 12 by removing four screws (not shown). This allows access to seal holder 122 and mechanical seal 112. Seal 112 may be slid off coupling 40 and replaced. Seal holder 122 has flats 124 on the outside diameter that may be gripped by a pair of pliers to unscrew seal holder 122 and remove it from motor adapter 18, thereby exposing seat 114. Seat 114 may be removed from bore 116 and replaced. Once a new seal 112 and seat 114 are installed and motor adapter 18 bolted onto motor 12, mechanical seal 112 has the correct compression. Since mechanical seals and seats are major wear items, and inexpensive to replace, having easy access provides great utility to the user.

Figure 5:
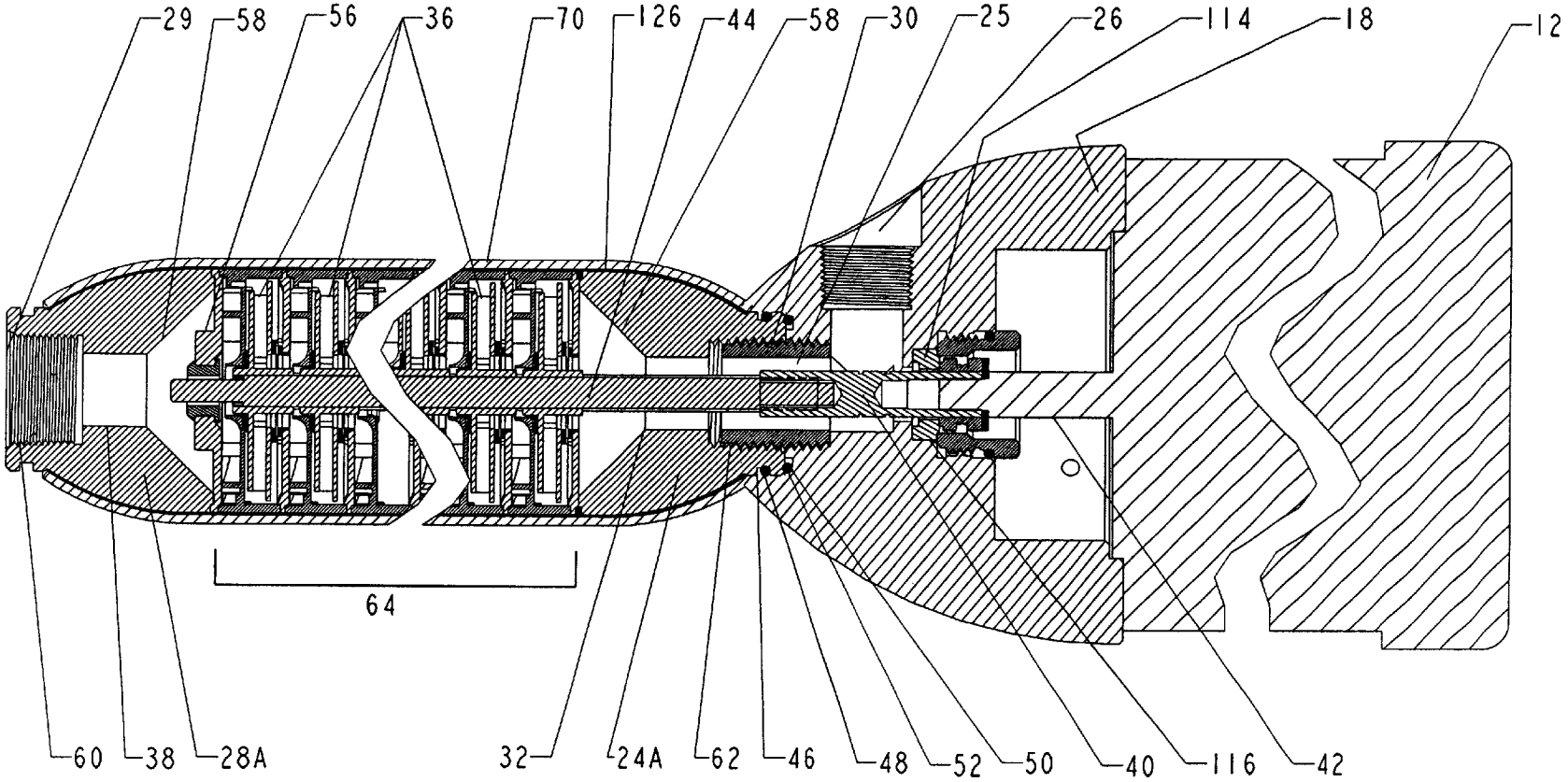
FIG. 5 is a cross sectional view of a pump unit, motor adapter, and motor assembly of another preferred embodiment.

As shown in FIG. 5, another embodiment of the invention substitutes a waterproof coating 126 for shrink-wrap shell 66, collars 68, and o-rings 54. This embodiment is similar to the first embodiment, except that the material of the waterproof inner layer is different, the method of applying the waterproof layer is different, and no o-rings or o-ring compression collars are necessary. FIG. 5 shows inlet housing 24A, discharge housing 28A, and waterproof layer 126. With respect to the other parts, similar numbers are used to identify similar parts, which were explained with reference to FIG. 2.

As with the previous example, an external, temporary, axial compressive force is applied to align and compress together inlet housing 24A, stages 36, and discharge housing 28A. Then, a waterproof material such as a rubber elastomer is applied over cartridge 64, inlet housing 24A, and discharge housing 28A to form waterproof layer 126 and to prevent rotation of diffusers 78 in cartridge 64. Because the material itself bonds to cartridge 64, inlet housing 24A and discharge housing 28A, o-rings and o-ring compression collars are not needed to create a watertight barrier. Thus, step 55 in inlet housing 24A and discharge housing 28A may be omitted. Additionally, the complete circumferential bonding between layer 126 and cartridge 64, inlet housing 24A. and discharge housing 28A prevents rotation of pump stages 36 of cartridge 64. One material that has been found to work well for layer 126 is a polysulfide-based rubber which comes in a thick liquid form. It is ideally applied to cartridge 64, inlet housing 24A, and discharge housing 28A as they are rotated slowly on a lathe. The application may be accomplished with a brush or stick, or by any other known method. One advantage of this material is that it is self-leveling; the surface evens out as it cures, resulting in a smooth surface on which composite shell 70 may be formed. The thickness of layer 126 may vary greatly, but in this example, a thickness of about 40 thousandths of an inch to about 80 thousandths of an inch has been found to work well. While layer 126 provides for waterproofing and rotation prevention, outer shell 70 lends structural integrity to the completed pump unit.

In conclusion, the present invention provides for an inexpensive, lightweight, efficient, and non-corrosive pump unit design and a convenient motor adapter configuration. While the principles of this invention have been described in connection with specific embodiments, it should be understood clearly that these descriptions are made only by way of example and are not intended to limit the scope of the invention. Workers skilled in the art will recognize that changes may be made in form and detail without departing from the spirit and scope of the invention.

What is claimed is:

1. A fluid pump comprising:

an inlet housing having an inlet port, a discharge housing having a discharge port;

a plurality of pumping stages positioned between the inlet housing and the discharge housing to form a generally cylindrical pump unit;

a continuous layer of waterproof material surrounding the generally cylindrical surface of the pump unit; and a structural shell surrounding the layer of waterproof material.

2. The pump of claim 1, wherein the layer is a made of a polymeric material that shrinks to conform to the shape of the inlet housing, the plurality of pumping stages, and the discharge housing.

3. The pump of claim 2, wherein the layer is made of polyolefin.

4. The pump of claim 2, wherein the inlet housing and the discharge housing each hold an o-ring, and wherein the o-rings provide:

a water-tight seal between the layer and the inlet housing, and a water-tight seal between the layer and the discharge housing.

5. The pump of claim 4, wherein the pump further comprises an o-ring compression collar placed over each o-ring.

6. The pump of claim 1, wherein the layer is a made of a material which is applied to the inlet housing, the plurality of pumping stages, and the discharge housing, so that the layer conforms to the shape of the inlet housing, the plurality of pumping stages, and the discharge housing.

7. The pump of claim 6, wherein the layer is made of an elastomer.

8. The pump of claim 6, wherein the layer is made of a self-leveling material.

9. The pump of claim 7, wherein the layer is made of a polysulfide-based compound.

10. The pump of claim 1, wherein the structural shell is a made of a composite material.

11. The pump of claim 10, wherein the composite material is wound onto the pump.

12. The pump of claim 10, wherein the structural shell is made of e-glass/epoxy composite material.

13. The pump of claim 1, wherein the inlet housing and the discharge housing are identical except for the threads therein.

14. The pump of claim 1, wherein the inlet housing and the discharge housing are molded from plastic.

15. A fluid pumping apparatus comprising:

a generally cylindrical pump unit having a threaded inlet port, a plurality of pumping stages each containing an impeller, and a discharge port; and a motor adapter for connecting the pump unit to a motor, the motor adapter having a fluid inlet, a threaded fluid outlet for connection to the inlet port of the pump unit, and an impeller shaft which extends axially through the inlet port of the pump unit and engages the impeller of each pumping stage when the inlet port of the pump unit is threadably attached to the fluid outlet of the motor adapter and the motor adapter and pump unit are in fluid communication, so that a fluid to be pumped enters the inlet of the motor adapter, flows through the fluid outlet of the motor adapter, through the inlet port of the pump unit, and out the discharge port of the pump unit.

16. The fluid pumping apparatus of claim 15 further comprising an o-ring seal which provides a water-tight seal between the pump unit and the motor adapter.

17. A connection system for connecting a motor to a pump unit in a fluid pumping apparatus, the system comprising:

a shaft coupling to connect a motor shaft and an impeller shaft;

a substantially cylindrical mechanical seal concentrically surrounding a portion of the shaft coupling;

a substantially cylindrical threaded mechanical seal holder concentrically surrounding the mechanical seal; and a motor adapter for holding the pump unit in alignment with the motor, the motor adapter having a mechanical seal stationary seat;

wherein the mechanical seal and mechanical seal holder are accessible when the motor adapter is disengaged from the motor; and wherein the mechanical seal stationary seat is accessible when the seal holder is disengaged from the motor adapter.

18. The connection system of claim 17 wherein the seal holder is threadably attached to the motor adapter.

* * * * *